US010500119B2

(12) United States Patent
Berg

(10) Patent No.: US 10,500,119 B2
(45) Date of Patent: Dec. 10, 2019

(54) STRETCHING DEVICE FOR THERAPY

(71) Applicant: Aaron Paul Berg, Taipei (TW)

(72) Inventor: Aaron Paul Berg, Taipei (TW)

( * ) Notice: Subject to any disclaimer, the term of this patent is extended or adjusted under 35 U.S.C. 154(b) by 290 days.

(21) Appl. No.: 13/731,038

(22) Filed: Dec. 30, 2012

(65) Prior Publication Data

US 2014/0187389 A1 Jul. 3, 2014

(51) Int. Cl.

| | |
|---|---|
| ***A61H 1/02*** | (2006.01) |
| ***A63B 23/035*** | (2006.01) |
| ***A63B 23/12*** | (2006.01) |
| ***A63B 21/062*** | (2006.01) |
| *A63B 23/00* | (2006.01) |
| *A63B 21/00* | (2006.01) |

(52) U.S. Cl.

CPC ..... *A61H 1/02* (2013.01); *A61H 1/0237* (2013.01); *A61H 1/0292* (2013.01); *A63B 21/0628* (2015.10); *A63B 23/03525* (2013.01); *A63B 23/1209* (2013.01); *A61H 2201/0161* (2013.01); *A61H 2201/1253* (2013.01); *A61H 2201/1284* (2013.01); *A61H 2201/168* (2013.01); *A63B 21/4035* (2015.10); *A63B 2023/006* (2013.01)

(58) Field of Classification Search

CPC ..... A61H 1/02; A61H 1/0292; A61H 1/0237; A61H 2201/1253; A61H 2201/1284; A61H 2201/0161; A61H 2201/168; A63B 21/0628; A63B 23/03525; A63B 23/1209; A63B 23/4035; A63B 2023/006

USPC ..... 482/81, 25, 140–141, 907, 131, 92, 482/121–123, 133–134, 148, 55, 56; 601/23–45; 472/54

See application file for complete search history.

(56) References Cited

U.S. PATENT DOCUMENTS

| | | | | |
|---|---|---|---|---|
| 864,188 | A | 8/1907 | Patterson | |
| 4,419,990 | A | 12/1983 | Forster | |
| 4,819,936 | A | 4/1989 | Muller | |
| 5,125,650 | A * | 6/1992 | Paris | 482/142 |
| 5,318,494 | A * | 6/1994 | Santighian | 482/125 |
| 5,456,649 | A | 10/1995 | Horkey | |
| 6,569,069 | B1 | 5/2003 | Linares | |
| 6,705,974 | B1 | 3/2004 | Tardif | |
| 7,614,988 | B1 * | 11/2009 | Kiser | 482/142 |
| 7,841,973 | B2 | 11/2010 | Trancart et al. | |
| 8,012,071 | B2 * | 9/2011 | Grisdale | 482/122 |
| 8,814,761 | B2 * | 8/2014 | Rich et al. | 482/95 |
| 2004/0209751 | A1 * | 10/2004 | Thonn, Jr. | 482/140 |
| 2005/0032612 | A1 * | 2/2005 | Keiser | 482/93 |
| 2005/0277526 | A1 * | 12/2005 | Bonnell | 482/123 |
| 2011/0230808 | A1 | 9/2011 | Lisowski | |

* cited by examiner

*Primary Examiner* — Megan Anderson

(57) ABSTRACT

A stretching device is provided. The stretching device includes a base. The base includes at least one frame extending forward and being in contact with an upright member extending upwardly from a front end thereof. The frame secures an inclined foot platform. The inclined foot platform tilts upward in the direction toward the upright member. The stretching device includes at least one gripping device. The gripping device includes at least one handlebar or handle loops mounted on the upright member and configured at a height that is between the shoulders and thighs of a user. The stretching device is configured such that the hands of the user are located in close proximity to the upright member when the device is in use.

2 Claims, 12 Drawing Sheets

STRETCHING DEVICE FOR THERAPY

FIELD OF THE INVENTION

The present invention relates to a stretching device, and more particularly to a stretching device for training and therapy.

BACKGROUND OF THE INVENTION

A conventional stretching device is disclosed in U.S. Pat. Nos. 5,456,649, 4,419,990, 864,188, yet it cannot cure muscle tension. Another conventional stretching device is disclosed in U.S. Pat. Nos. 7,841,973, 6,705,974, 4,819,936 so as to stretch muscle groups, such as hamstrings, calves and Achilles tendons, but it cannot stretch muscles of an upper body.

In addition, U.S. Pat. No. 6,569,069 discloses a 'Back Stretcher' device which is used to stretch the spine but it is only applied to stretch abdominal muscles, so the back muscles cannot be stretched effectively.

Also, a traction exercise apparatus is disclosed in U.S. patent Ser. No. 12/729,016 and US Publication No. 2011/0230808, yet the user's legs have to be tied and the body is hanged upside down, having an unsafe and impractical operation. Furthermore, the user must use much force to grip the handle bars thus not allowing his shoulders to relax, the position of the users head tilting backward is contrary to the position needed to fully stretch the back and neck, the position of the user's feet are not flexed to stretch the calves and hamstrings, thus the therapeutic stretching is insufficient and incomplete.

The present invention has arisen to mitigate and/or obviate the afore-described disadvantages.

SUMMARY OF THE INVENTION

The primary object of the present invention is to provide a stretching device for therapy which in operation, the base is placed on the ground, and the inclined foot platform is sloped 30 to 40 degrees relative to the ground, then the frame abuts against the upright member, and frame is adjusted to match various users' body sizes and flexibility levels, thereafter a user stands on the inclined foot platform, stoops down and places his/her hands through and grips the two handle loops while keeping legs straight and leaning backward to stretch his/her body, hence the user is capable of stretching calves, hamstring, lower back, upper back, shoulder and neck, also to provide traction to the spine.

To obtain the above objectives, a stretching device is provided.

In one aspect of the present invention, the stretching device includes a base. The base includes at least one frame extending forward and being in contact with an upright member extending upwardly from a front end thereof. The frame secures an inclined foot platform. The inclined foot platform tilts upward in the direction toward the upright member. The stretching device includes at least one gripping device. The gripping device includes at least one handlebar or handle loops mounted on the upright member and configured at a height that is between the shoulders and thighs of a user. The stretching device is configured such that the hands of the user are located in close proximity to the upright member when the device is in use.

In another aspect of the present invention, the stretching device includes a base. The base includes a first frame, a second frame, and a third frame. The first frame secures an inclined foot platform. The base extends forward and is in contact with an upright member extending, upwardly from a front end thereof. The stretching device also includes at least one gripping device. The gripping device includes at least one handlebar or handle loops mounted on the upright member. The second frame is axially connected with the front end of the first frame. The third frame is coupled with the rear end of the second frame. The inclined foot platform is axially connected with a rear end of the first frame by a plurality of first hinges. At least one adjustable support is operatively associated with the foot platform such that the inclined foot platform may be pivoted from a flat position to a plurality of incline positions. The second frame is extended and located at a flat plane with the first frame or may be folded to overlap with the first frame. The third frame includes two legs that are inserted into two grooves of the second frame. The legs may be inserted into the grooves and fixed by a fixing mechanism at a plurality of depths thereby adjusting the length of the base.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
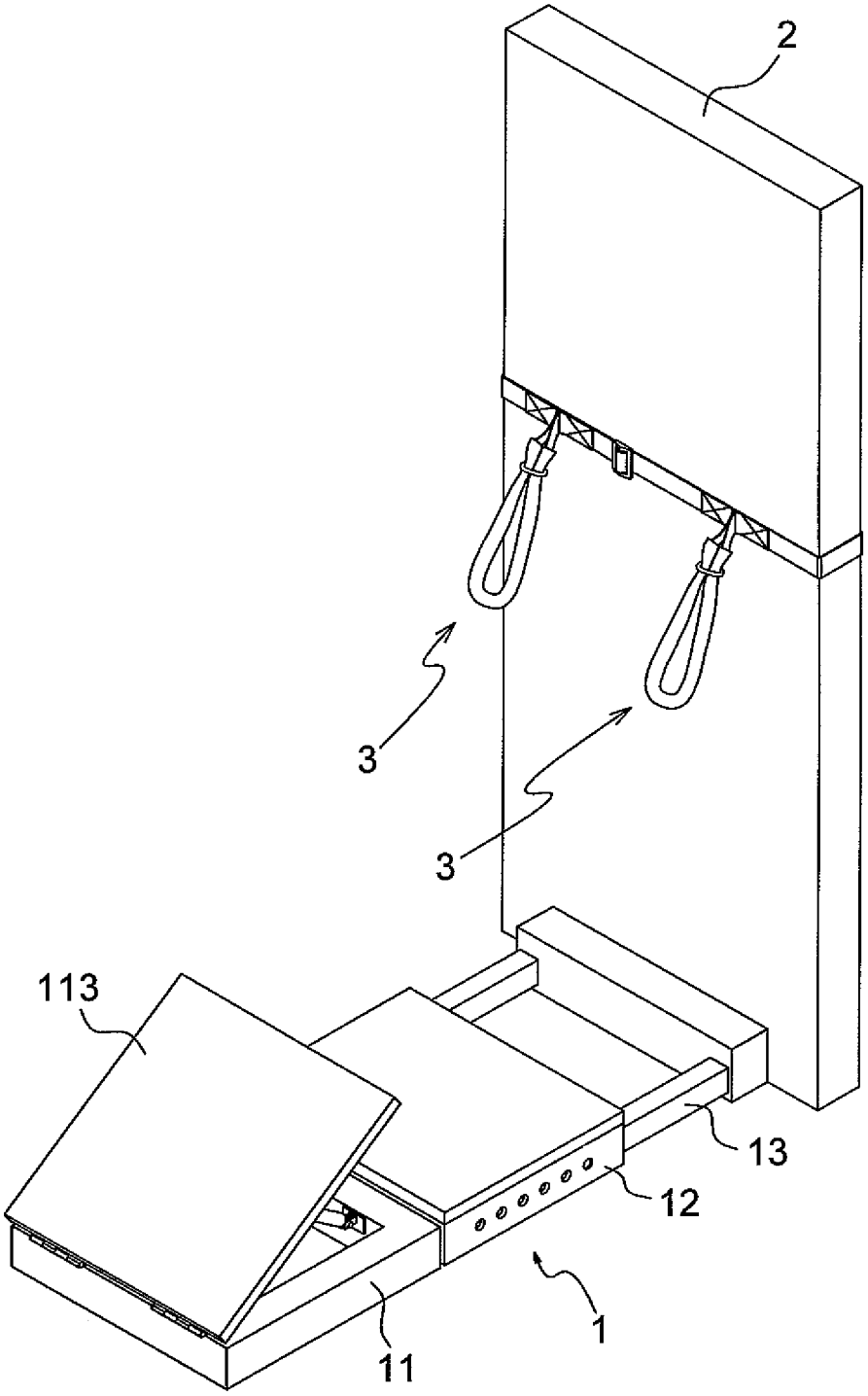
FIG. 1 is a perspective view showing the assembly of a stretching device for therapy according to a first embodiment of the present invention.

With reference to FIG. 1, a stretching device for therapy according to a first embodiment of the present invention comprises a base 1, placed on the ground, connecting to or abutting against an upright member 2 (such as a closed door in a doorway), and including a first frame 11 disposed on a rear end thereof; and two handle loops 3 mounted on the upright member 2. A user may choose a closed door which is appropriate to perform stretching using the invention.

Referring to FIG. 1, the base 1 further includes the first frame 11, a second frame 12, and a third frame 13, wherein the first frame 11 has an outer rack 111, two adjustable supports 112, and an inclined foot platform 113, the inclined foot platform 113 is axially connected with the rear end of the first frame 11 by way of a plurality of first hinges 114, such that the inclined foot platform 113 is folded on or tilted relative to the outer rack 111.

It is preferable that the two adjustable supports 112 are positioned at a plurality of positions so that a slope of the inclined foot platform 113 is adjustable.

The second frame 12 is axially connected with the front end of the first frame 11 by ways of a plurality of second hinges 116, so it is extended and located at a flat plane with the first frame 11 or is folded to overlapped with the first frame 11.

Figure 2:
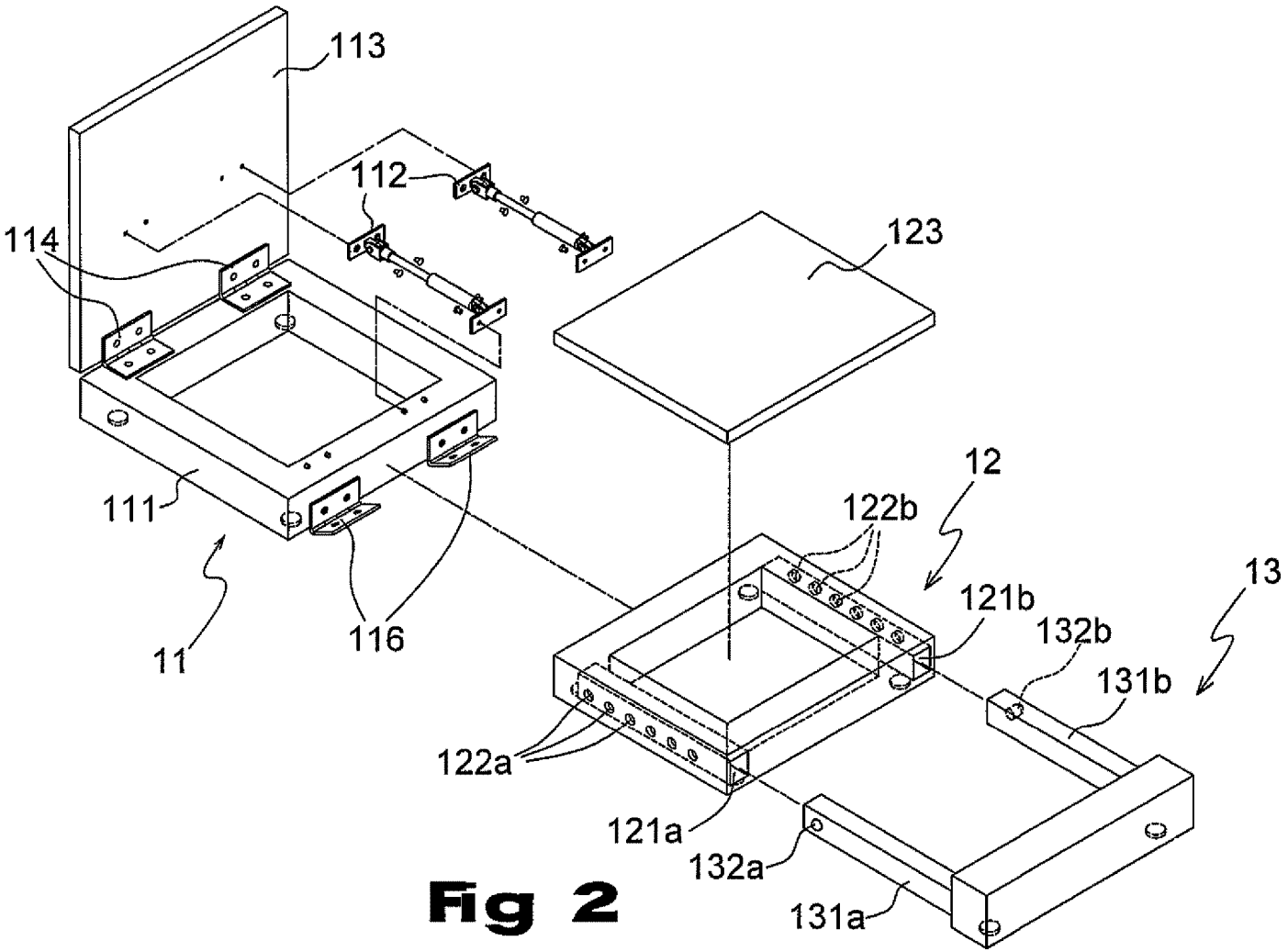
FIG. 2 is a perspective view showing the exploded components of the stretching device for therapy according to the first embodiment of the present invention.

The third frame 13 is coupled with the second frame 12. The second frame 12 has two parallel grooves 121*a*, 121*b* defined therein, and the third frame 13 is formed in a U shape and has two legs 131*a*, 131*b* inserted into the two grooves 121*a*, 121*b*. A fixing mechanism is defined between the second frame 12 and the third frame 13. As shown in FIG. 2, the fixing mechanism includes a plurality of holes 122*a*, 122*b* formed in the two grooves 121*a*, 121*b* and two movable balls 132*a*, 132*b* fixed on the legs 131*a*, 131*b*. When the third frame 13 slides inwardly or outwardly, one of the plurality of holes 122*a*, 122*b* retains with one of the two movable balls 132*a*, 132*b* so that the third frame 13 is fixed. In other words, a length of the second frame 12 and the third frame 13 is defined between the plurality of holes 122*a*, 122*b* and the two movable balls 132*a*, 132*b*, thus adjusting the second frame 12 and the third frame 13.

Figure 3:
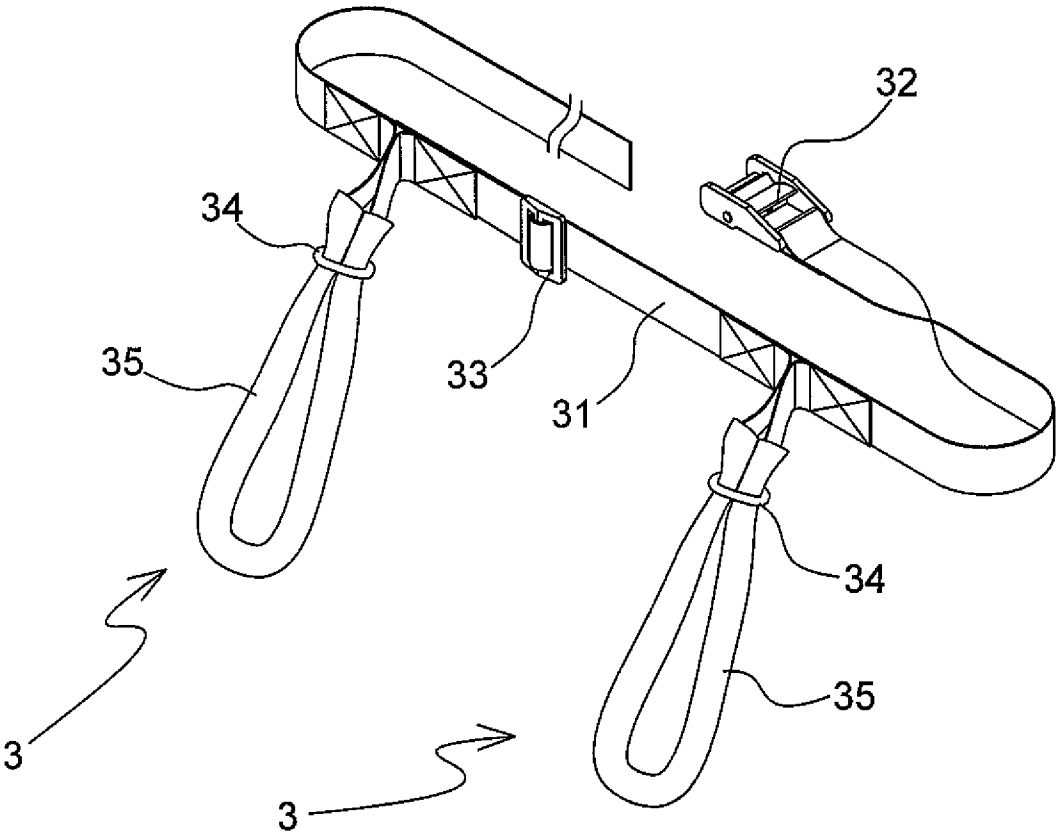
FIG. 3 is another perspective view showing the assembly of the stretching device for therapy according to the first embodiment of the present invention.

Referring further to FIG. 3, the two handle loops 3 are fixed on an adjusting belt 31, and the adjusting belt 31 has a cam buckle 32 mounted on one end thereof and an adjustment fastener 33 so that the adjusting belt 31 is tied on the upright member 2 (as illustrated in FIG. 1). Accordingly, a user places one of his/her hands through each handle loop 3 and grips his/her fingers around the handle loop 3 on the other side to prevent his/her hands from slipping out. Each handle loop 3 has a rigid ring 34 fitted thereon so as to lessen the mouth of each handle loop 3, such that the user pulls the rigid ring around the handle loops closer to his/her hands to make the handle loop size smaller and easier to grip. Each handle loop 3 also has a foam sleeve 35 covered thereon so as to hold the user's hands in each handle loop 3 comfortably and securely. Preferably, the belt with handle loops is to be used with the frame and foot pedestal, and it can be also used independently. For example, when traveling, it may not be convenient to carry the inclined foot pedestal; however, the belt may be easily carried and used on any door or upright member for the user to stretch his back and shoulders in a similar way.

The belt with handle loops can be also used independently without the frame and foot pedestal.

Figure 4:
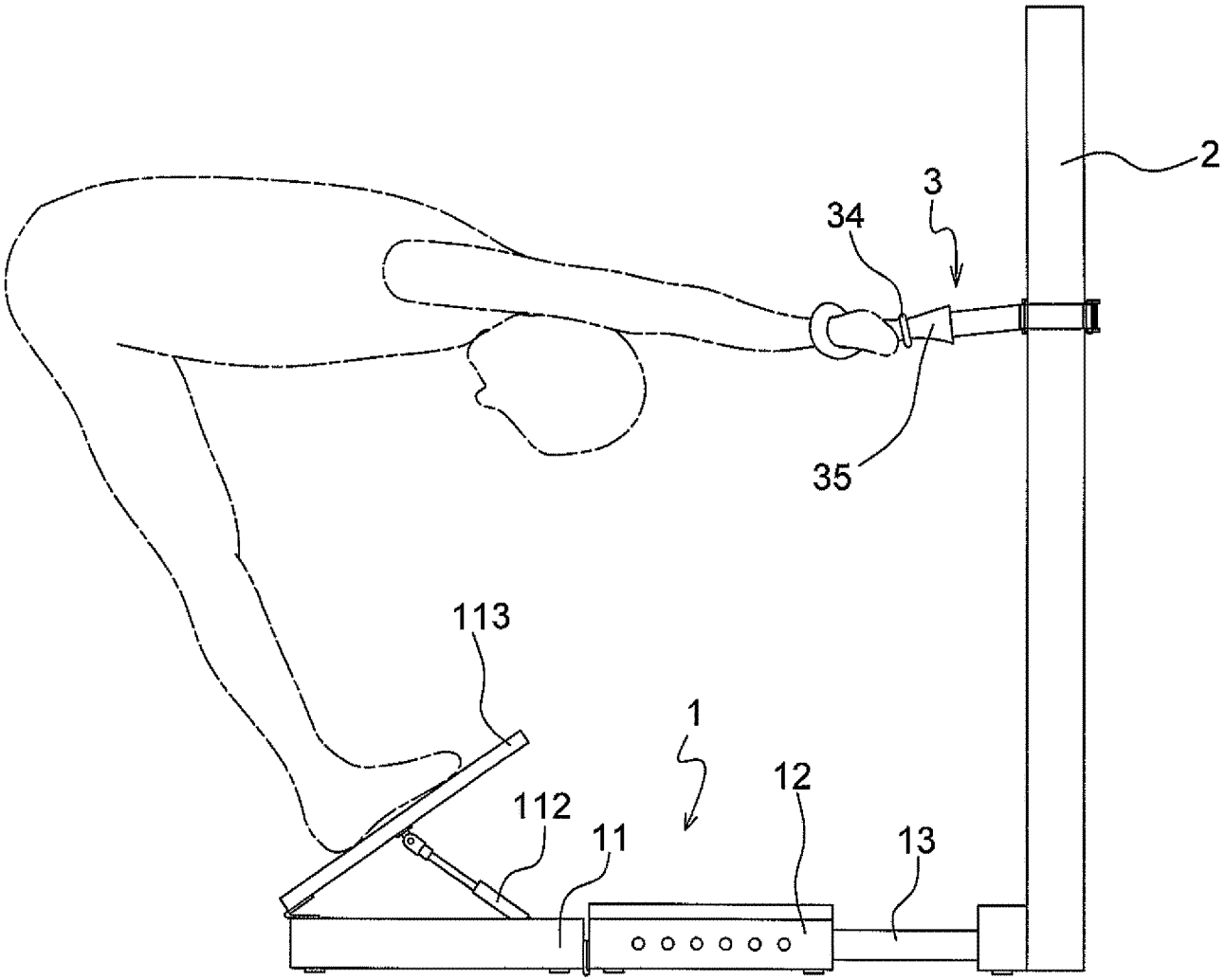
FIG. 4 is a plan view showing the operation of the stretching device for therapy according to the first embodiment of the present invention.

With reference to FIG. 4, in operation, the base 1 is placed on the ground, and the inclined foot platform 113 is sloped 30 to 40 degrees relative to the ground, then the third frame 13 abuts against the upright member 2, and the third frame 13 is adjusted to match various users' body sizes and flexibility levels, thereafter a user stands on the inclined foot platform 113, stoops down and places his/her hands through and grips the two handle loops 22 while keeping legs straight and leaning backward to stretch his/her body, hence the user is capable of stretching calves, hamstring, lower back, upper back, shoulder and neck, also to stretch the spine. It is to be noted that the two handle loops 3 are fixed at a height of the upright member 2 approximately relative to the user's waist, and a width between the two handle loops 3 is equal to a width of the user's shoulder.

Figure 5:
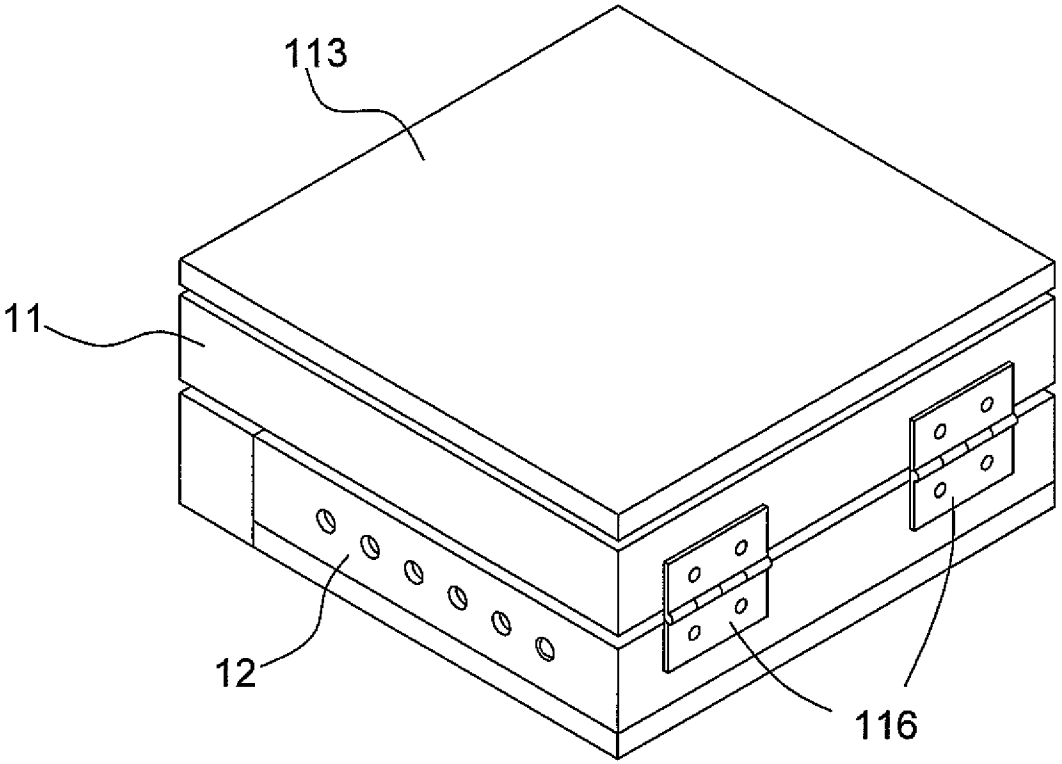
FIG. 5 is a plan view showing the foldable operation of the angle inclining structure for convenient stowage according to the preferred embodiment of the present invention.

As shown in FIG. 5, when the stretching device is not used, the base 1 is folded to be more compact. In detail, the first frame 11 or the second frame 12 is turned to superpose each other. This makes the stretching device easy to be stored.

Figure 6:
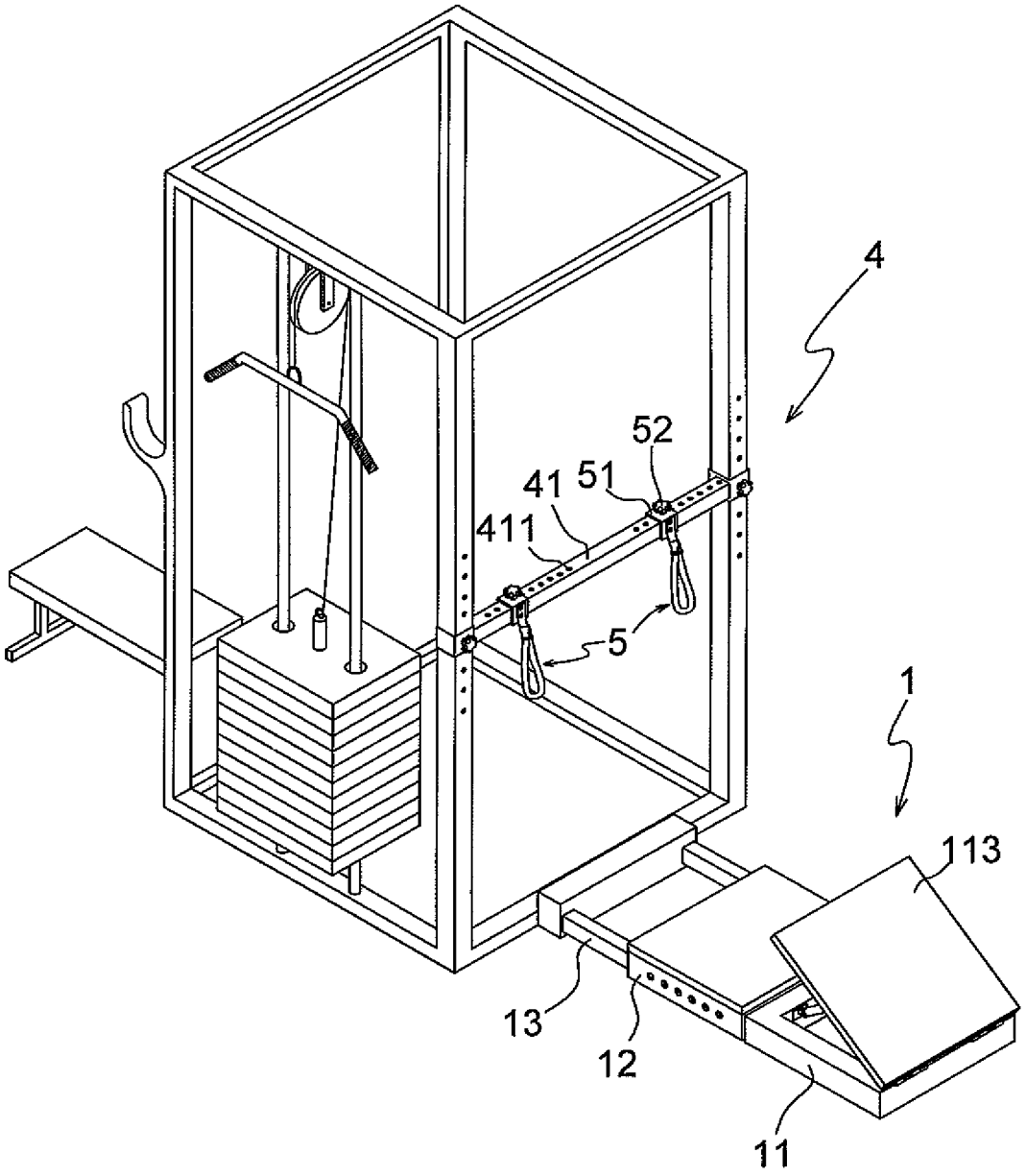
FIG. 6 is a perspective view showing the assembly of a stretching device for therapy according to a second embodiment of the present invention.

As illustrated in FIG. 6, a stretching device for therapy according to a second embodiment of the present invention comprises a base 1, the base 1 matches with an upright member of a fitness device 4, and the fitness device 4 includes a horizontal rod 41 mounted on one side thereof and facing to the base 1, the horizontal rod 41 has two handle loops 5 disposed on two fitting seats 51, and each fitting seat 51 is fitted on the horizontal rod 41 and has a fixing element 52 for fixing the each fitting seat 51 on the horizontal rod 41. The horizontal rod 41 has plural orifices 411 for inserting two fixing elements 52 therein so as to adjust a width between the two handle loops 5.

Figure 7:
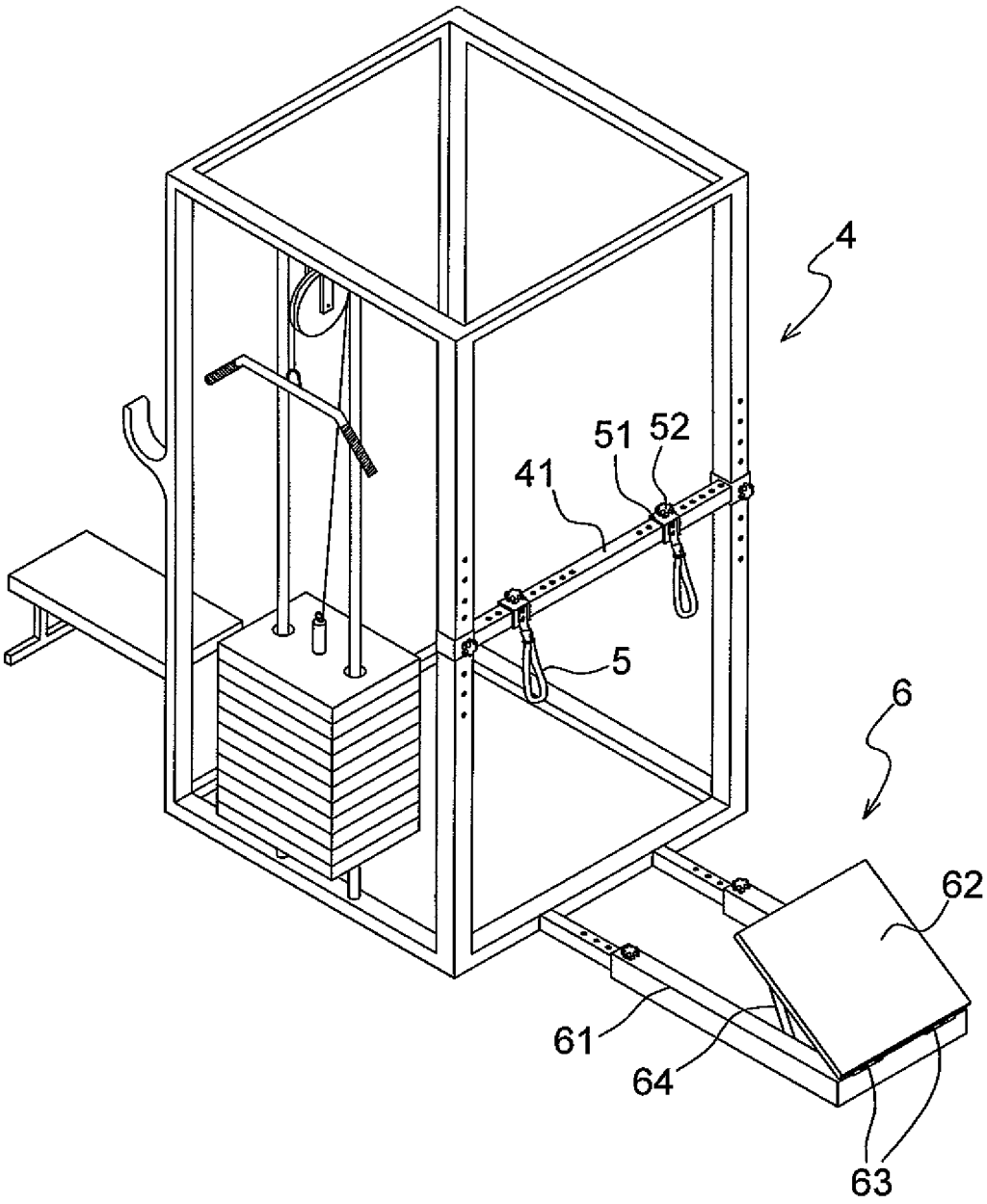
FIG. 7 is a perspective view showing the assembly of a stretching device for therapy according to a third embodiment of the present invention.

Referring to FIG. 7, a stretching device for therapy according to a third embodiment of the present invention matches with an upright member of a fitness device 4, and the fitness device 4 is integrally connected with a base 6, and the base 6 includes an adjustable mount 61 and a inclined foot platform 62. The inclined foot platform 62 is connected with a rear end of the adjustable mount 61 by ways of plural hinges 63, and between the inclined foot platform 62 and the adjustable mount 61 are defined two posts 64. Thereby, the inclined foot platform 62 is overlapped or obliquely fixed on the adjustable mount 61 so that the inclined foot platform 62 is lifted to be used as an oblique platform.

Figure 8:
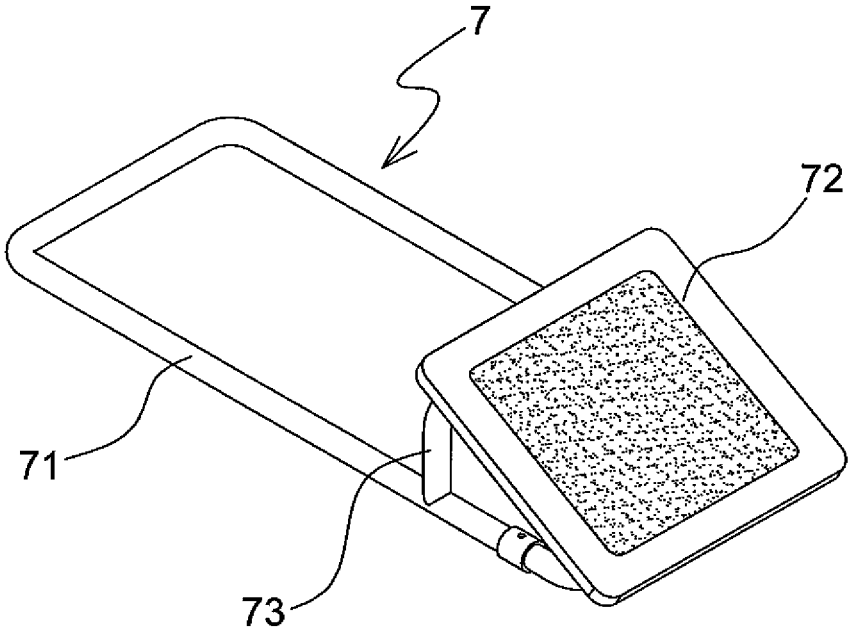
FIG. 8 is a perspective view showing the assembly of a non-adjustable inclined foot platform of a stretching device for therapy according to a fourth embodiment of the present invention.

Referring to FIG. 8, a stretching device for therapy according to a fourth embodiment of the present invention comprises a base 7, and the base 7 includes a frame 71 and an inclined foot platform 72. The inclined foot platform 72 has a rear end coupled with a rear end of the frame 71, and the frame 71 and the inclined foot platform 72 are supported by a supporting rack 73 so as to form a beveled angle between the frame 71 and the inclined foot platform 72, the frame 71 extends outward from a front end of the inclined foot platform 72 so as to abut against an upright member 2.

Figure 9:
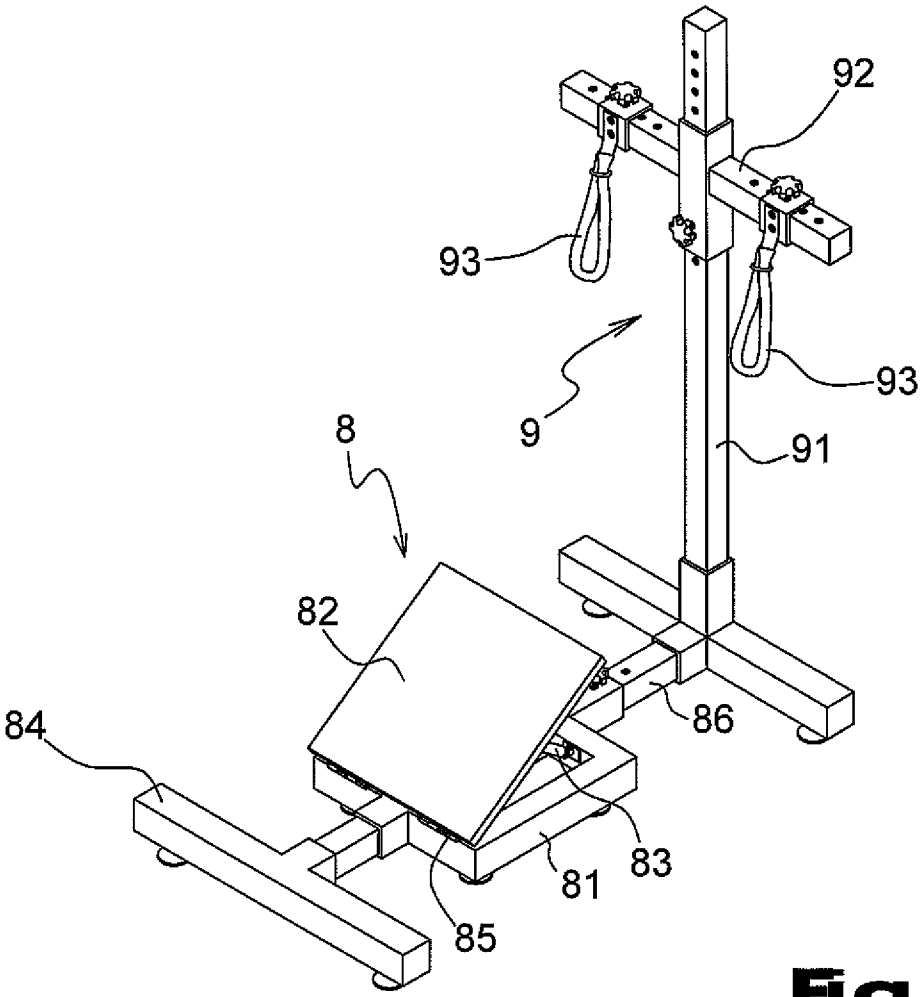
FIG. 9 is a perspective view showing the assembly of a stretching device for therapy according to a fifth embodiment of the present invention.

With reference to FIG. 9, a stretching device for therapy according to a fifth embodiment of the present invention comprises a base 8, the base 8 includes a frame 81, a inclined foot platform 82, two adjustable supports 83, and a fixed pedestal 84. The inclined foot platform 82 is connected with a rear end of the frame 81 by means of plural hinges 85, and the frame 81 is mounted on the fixed pedestal 84, the two adjustable supports 83 are fixed between the inclined foot platform 82 and the frame 81, and the two adjustable supports 83 are positioned at a plurality of positions so that the inclined foot platform 82 is lifted to be used as an oblique platform. The fixed pedestal 84 has a front end coupling with an upright member 9, and the upright member 9 has a column 91 on which a movable stem 92 is disposed, and the movable stem 92 has two handle loops 93.

Figure 10:
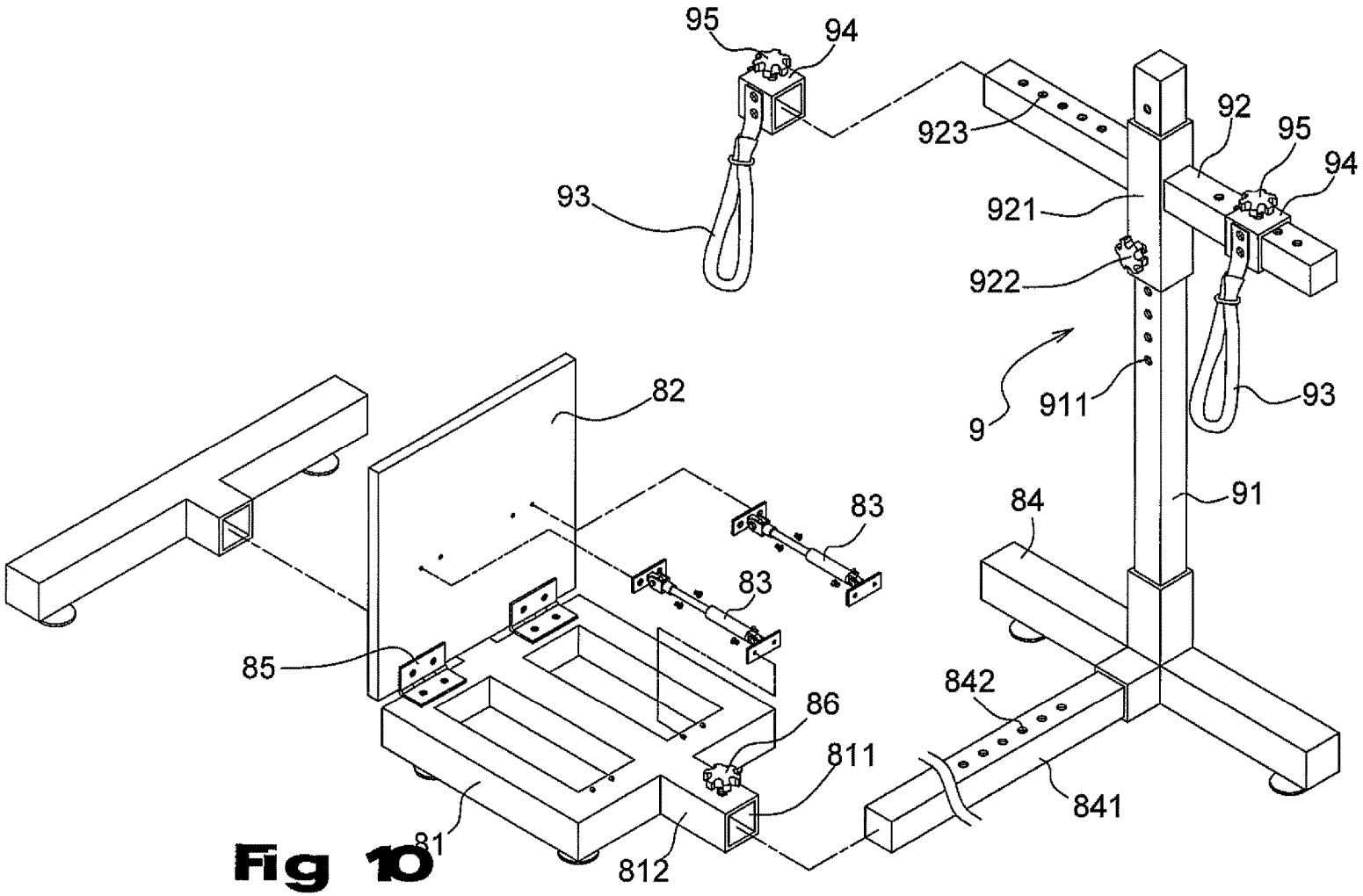
FIG. 10 is a perspective view showing a part of the exploded components of a stretching device for therapy according to a fifth embodiment of the present invention.
Figure 11:
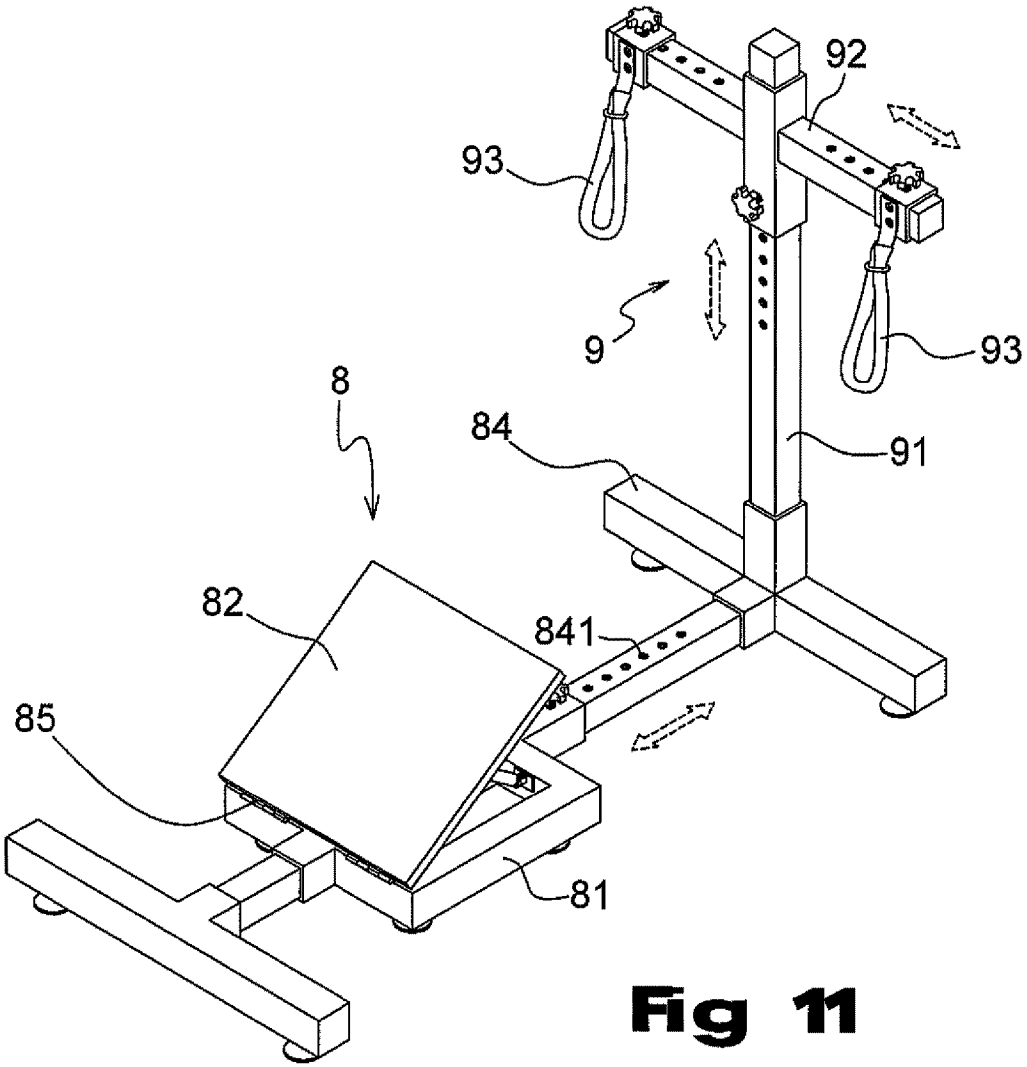
FIG. 11 is a perspective view showing the operation of the stretching device for therapy according to the fifth embodiment of the present invention.
Figure 12:
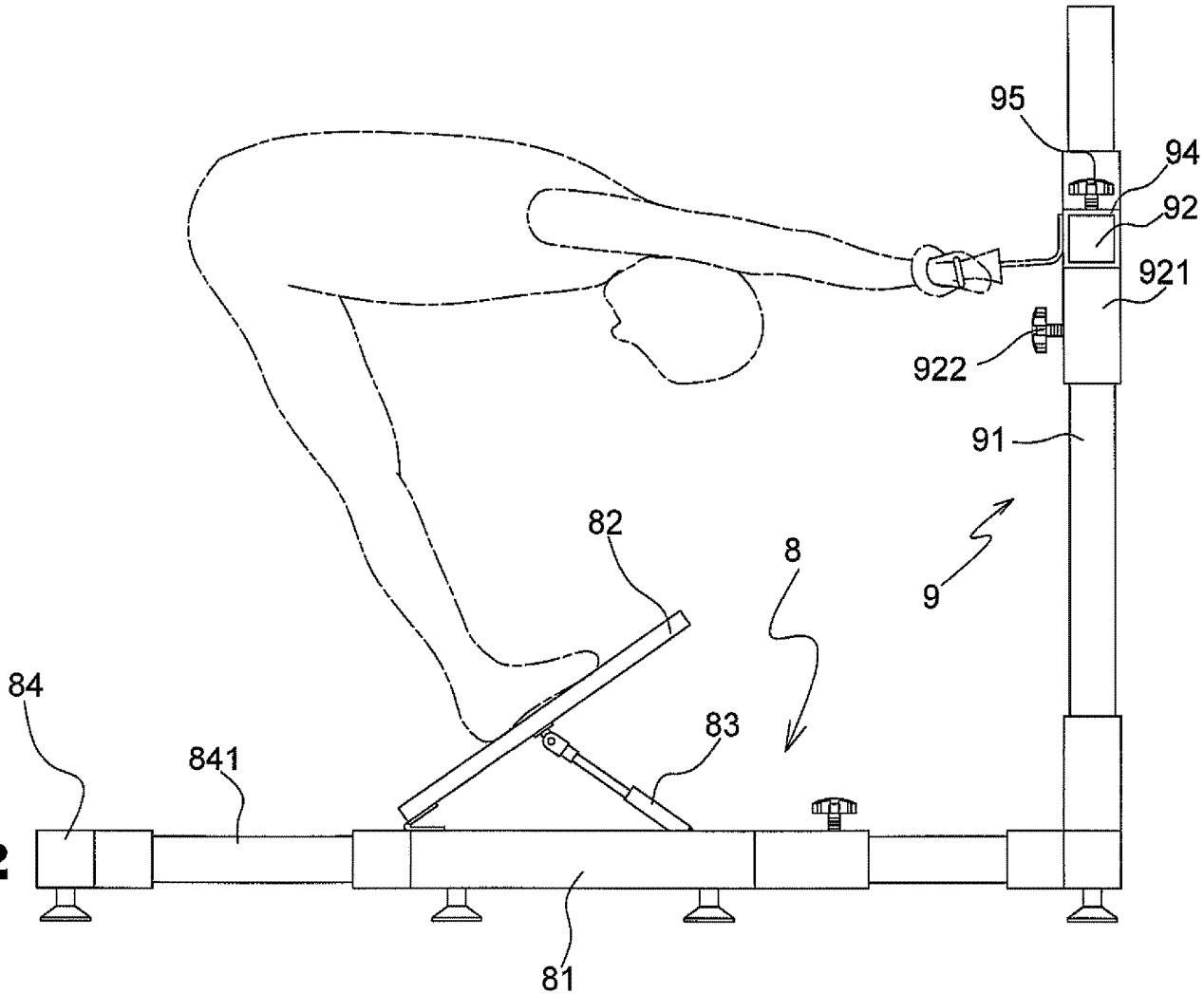
FIG. 12 is a plan view showing the operation of a stretching device for therapy according to the fifth embodiment of the present invention.

As shown in FIG. 10, the frame 81 has a slot 811 defined therein so as to fit an extension 841 of the fixed pedestal 84, such that the fixed pedestal 84 is moved and fixed on the frame 81, wherein the slot 811 is defined in a tube 812 of the frame 81, and two ends of the tube 812 extend out of the frame 81, wherein the tube 812 has a first fix knob 86 mounted thereon, and the extension 841 has a plurality of apertures 842 defined thereon relative to the first fix knob 86.

The movable stem 92 of the upright member 9 has a sheath 921 arranged on a central position thereof so as to fit the column 91, and the sheath 921 has a second fix knob 922 disposed thereon so that the movable stem 92 is positioned on the column 91. The column 91 has a plurality of openings 911 defined thereon so as to insert the second fix knob 922.

The two handle loops 93 are mounted on a locking holder 94, and the locking holder 94 is fitted on the movable stem 92 and has a third fix knob 95 for fixing the locking holder 94 on the movable stem 92, the movable stem 92 has a plurality of pores 923 formed thereof so as to insert the fix knob 95.

Thereby, the base 1 is moved and fixed on the extension 841 of the fixed pedestal 84, the plurality of openings 911 of the column 91 are served to adjust the movable stem 92 at a suitable height of the column 91, and the two handle loops 93 are moved on the horizontal rod 41 by means of the locking holder 94 and are fixed in two of the plurality of pores 923 so as to adjust a distance between the two handle loops 93.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A stretching device comprising:

a base, wherein the base includes a first frame, a second frame, and a third frame, wherein the first frame secures an inclined foot platform, wherein the base extends forward and is in contact with an upright member extending upwardly from a front end thereof;

at least one gripping device, wherein the gripping device comprises at least one handlebar or handle loops mounted on the upright member, wherein the second frame is axially connected with the front end of the first frame, wherein the third frame is coupled with a rear end of the second frame, wherein the inclined foot platform is axially connected with a rear end of the first frame by a plurality of first hinges; and at least one adjustable support operatively associated with the inclined foot platform such that the inclined foot platform is configured to be pivoted from a flat position to a plurality of incline positions, the second frame is extended and located at a flat plane with the first frame or is configured to be folded to overlap with the first frame, wherein the third frame includes two legs that are inserted into two grooves of the second frame, said two legs is configured to be inserted into said two grooves and fixed by a fixing mechanism at a plurality of depths thereby adjusting a length of the base.

2. A stretching device, comprising:

a base comprising at least one frame extending forward and being in contact with an upright member extending upwardly from a front end thereof, said at least one frame securing an inclined foot platform, wherein the inclined foot platform tilts upward in the direction toward the upright member, and at least one gripping device, wherein the at least one gripping device comprises at least one handlebar or handle loops mounted on the upright member and configured at a height that is between shoulders and thighs of a user, said stretching device is configured such that hands of the user are located in close proximity to the upright member when the stretching device is in use; and wherein the at least one frame comprises horizontal front and rear bars and at least one supporting extension bar connected perpendicular to and between the horizontal front and rear bars, wherein the front end of said at least one frame is attached at a right angle to the upright member, wherein the inclined foot platform is adjustably fixed to the extension bar such that the inclined foot platform is configured to move along the at least one supporting extension bar to a position closer to or further from the upright member, wherein the extension bar includes a series of apertures along the length of the at least one supporting extension bar, wherein the foot platform slides along the length of said at least one supporting extension bar utilizing a fixing member inserted into a selected aperture to fix the position of the foot platform.

* * * * *